US007694539B2

(12) United States Patent
Muenstermann

(10) Patent No.: US 7,694,539 B2
(45) Date of Patent: Apr. 13, 2010

(54) SUCTION APPARATUS FOR A FABRIC-TREATMENT WATER-JET BEAM

(75) Inventor: Ullrich Muenstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 734 days.

(21) Appl. No.: 11/514,304

(22) Filed: Aug. 30, 2006

(65) Prior Publication Data

US 2007/0051141 A1 Mar. 8, 2007

(30) Foreign Application Priority Data

Sep. 3, 2005 (DE) ..... 10 2005 041 904
Jun. 30, 2006 (DE) ..... 10 2006 030 701

(51) Int. Cl.
*D06B 5/02* (2006.01)

(52) U.S. Cl. ..... 68/19.1; 68/19.2; 68/205 R

(58) Field of Classification Search ..... 68/19, 68/19.1, 205 R
See application file for complete search history.

(56) References Cited

U.S. PATENT DOCUMENTS 3,766,756 A * 10/1973 Farrar ..... 68/19.1
3,973,902 A * 8/1976 Zimmermann et al. ..... 8/499
4,870,462 A 9/1989 Day
6,085,699 A * 7/2000 Valcic et al. ..... 122/13.01
6,203,858 B1 * 3/2001 Plomer ..... 427/425
6,457,335 B1 10/2002 Fleissner
6,957,607 B2 * 10/2005 Biagiotti ..... 101/424
7,022,185 B2 * 4/2006 Nissinen et al. ..... 118/325
2008/0135196 A1 * 6/2008 Backman et al. ..... 162/199

FOREIGN PATENT DOCUMENTS

DE 196 04 504 * 8/1997
JP 10-224089 * 8/1998
KR 2004089419 * 10/2004
WO 01/40562 6/2001

* cited by examiner

*Primary Examiner*—Frankie L Stinson
(74) *Attorney, Agent, or Firm*—Andrew Wilford

(57) ABSTRACT

A suction apparatus for a water beam that directs a liquid jet at a passing a fabric web workpiece has a suction chamber extending transversely adjacent the jet and having a perforated lower wall sloping downward away from an upper region close to the water beam and a lower region remote therefrom. Air is withdrawn from inside the chamber to aspirate spray from adjacent the jet through the perforated lower wall.

20 Claims, 4 Drawing Sheets

SUCTION APPARATUS FOR A FABRIC-TREATMENT WATER-JET BEAM

FIELD OF THE INVENTION

The present invention relates to a water-jet beam for treating a fabric. More particularly this invention concerns a suction apparatus or chamber for such a beam.

BACKGROUND OF THE INVENTION

In the manufacture of a fabric web workpiece, e.g. woven, knitted, or nonwoven fabric including felts and fleeces made of staple fibers, continuous filaments or cellulose fibers and even having multiple layers. Such fabrics are typically treated by passing them over a support and directing high-pressure liquid jets at them from an overhead jet beam. A perforated suction surface provided below the jet beam aspirates the spray. A so-called suction chamber is provided between the jet beam and the workpiece to aspirate spray created by the process.

It is known from U.S. Pat. No. 6,457,335 to collect the liquid spraying against the water beam. Here the suction apparatus is located to the side of the water beam and extends along its entire length. A funnel-shaped slot formed at the edge of the water beam has a slot width of approximately 2 mm at its inner end. If a sufficiently strong vacuum is connected to the otherwise completely enclosed apparatus, all the droplets including any spray mist from the underside of the water beam can be aspirated safely from the goods being needled.

A water beam for the water needling of fabrics is further known from WO 2001/040562 of Vuillaume that has a suction chamber attached to the water beam in an upper region and forming a groove adjacent the water jets, with a porous floor adjacent this groove. Thus spray is aspirated both through the groove and through the porous floor. Spray can only inadequately be removed with this apparatus. Furthermore, spray cannot be aspirated on the opposite side of the water jet.

OBJECTS OF THE INVENTION

It is therefore an object of the present invention to provide an improved suction apparatus for a fabric-treatment water-jet beam.

Another object is the provision of such an improved suction apparatus for a fabric-treatment water-jet beam that overcomes the above-given disadvantages, in particular that ensures that spray does not interfere with the water jets emerging from the water beam.

SUMMARY OF THE INVENTION

A suction apparatus for a water beam that directs a liquid jet at a passing a fabric web workpiece. The apparatus has according to the invention a suction chamber extending transversely adjacent the jet and having a perforated lower wall sloping downward away from an upper region close to the water beam and a lower region remote therefrom, and means for withdrawing air from inside the chamber and thereby aspirating spray from adjacent the jet through the perforated lower wall.

This way in a simple and cost-effective manner an approximately drop-free water beam is ensured and the spray is aspirated completely on both sides of the water jet so that drops can no longer fall on the fabric workpiece, which can result in contamination or impairment. The removal of the spray is particularly effective because the water drops collected on the sloping surface of the suction chamber move toward the lower region of the suction surface as a result of gravity and thus move away from the water jet. For this purpose the region of the suction chamber facing the water beam can also be formed without a drip edge.

For this purpose, it is advantageous that the perforated suction surface comprises openings provided with a cross-sectional area of different size. This ensures a uniform suction pressure over he entire suction surface of the suction apparatus.

It is furthermore advantageous that the cross-sectional areas of the openings are increasingly larger beginning from the drip edge.

It is also advantageous that the cross-sectional areas of the openings are increasingly larger, continuously or in uniform steps, beginning from the drip edge.

It is also advantageous that the distance between the individual openings is the same or different.

It is furthermore advantageous that an angle is formed by a tangent of a perforated roller and the perforated suction surface, this angle being between 5° and 25°, in particular between 6° and 15°, the openings of the suction surface on the inner side facing a water jet accounting for an open area of about 3% to 8%, preferably 5% and on the outer side, about 10% to 25%, preferably 20%. As a result, a stronger air flow is achieved on the outer side of the suction surface than on the inner side. The water droplets which migrate toward the lower and therefore outer area of the suction surface as a result of gravity, are then finally sucked into the interior of the suction chamber via the large openings.

In a further embodiment of the invention it is advantageous that the water beam and/or the suction chamber has at least one air-supply means that has at least one outlet opening provided adjacent the water beam. As a result, the water jet is supplied with an additional and independent dry air flow. At the same time, the suction effect of the water jet running at up to 200 m/s is used. This now no longer sucks the moist ambient air enriched with spray mist but the dry air provided via the air supply apparatus. This can prevent deflection of the water jet caused by very fine water droplets in the air.

It is furthermore advantageous that the air supply apparatus has an air-supply passage which has a width measured perpendicular to the vertical plane of the liquid jet of 1 to 15 mm, preferably 3 to 10 mm and in particular, 3 and 6 mm and defined between an outer face of the water beam and an outer face of the suction chamber facing the water beam. In this particularly simple embodiment of the air supply apparatus, the air-supply passage is formed by an air gap between the water beam and the suction chamber. Thus, substantially no additional components are required for this. However, the air-supply passage can also be formed, for example, by means of installed hoses.

In an advantageous embodiment of the air supply apparatus, air supply to the water jet can take place in such a manner that the air supply apparatus has a blower to produce an excess pressure in the air-supply passage. Thus, dry air is actively supplied to the water jet and the air supply to the water jet is provided not exclusively on the basis of the suction effect described above but also as a result of a lower excess pressure inside the air-supply passage.

According to a further feature of the invention, it is advantageous that the outlet opening extends approximately over the entire length of the water beam. This simply ensures that the water jet is supplied with dry air over the entire length of the water beam and is thus not influenced by fine water droplets or spray mist.

In a further embodiment of the invention it is advantageous that the outlet opening of the air supply apparatus is designed so that the air flow impinges approximately perpendicularly on the water jet emerging from the water beam. The emerging water jet is hereby simply focused and spray guided in the direction of the water jet.

It is also advantageous that the air supply apparatus or the air gap is provided at least partly between the water beam and the outlet opening of the suction chamber or is guided along the outer side of the water beam and runs parallel thereto in an area of the lower wall of the water beam. The emerging water jet is focused with the aid of the dry air flow emerging from the air supply apparatus adjacent the underside of the water beam. In this case, the air flow which is introduced is protected from spray as far as the outlet since the air-supply passage is defined by the suction chamber in the downward direction.

An additional possibility according to a further development of the invention is that the suction chamber and/or the air supply apparatus are each arranged symmetrically on both sides of the water beam and/or the water jet. Spray bouncing off the fabric can thus be sucked off in the running direction of the fabric after impingement of the water jet or before the water jet if necessary, as desired. Dry air can thus be supplied independently via the air supply apparatus both before and after the water jet. In this case, the arrangement of the suction chamber and the air supply apparatus can be made in any combinations independently of one another.

For this purpose it is advantageous that the openings of the perforated suction surface on the inner side facing the water jet are preferably embodied as parallel slots having a length between 1 mm and 10 mm and a width between 0.1 mm and 3 mm and the openings provided on the outer side of the perforated suction surface are preferably embodied as angular having a length between 1 mm and 10 mm and a width between 0.1 mm and 3 mm.

In this case, it is particularly advantageous that the openings have differently shaped cross-sectional areas and are embodied as oval, polygonal, angular or as elongated slots. Such an arrangement and shape of the openings ensures that as they migrate along the surface in the direction of the lower area of the suction surface, the droplets are forced to pass through the openings and cannot easily bypass them. It is particularly effective if the angular openings of the perforated suction surface are provided with a relatively large open area in this region.

It is particularly important for the present invention that an air-displacement body is positioned in the suction chamber such that a uniform suction effect is ensured over the entire width and/or length of the perforated suction surface since the suction takes place on one side. As a result of this arrangement of the air-displacement body, air flows inside the suction chamber are finely adjusted as required. A particular flexibility is achieved if the air-displacement body is mounted such that its height and inclination can be varied.

It is furthermore advantageous that the air-displacement body is located above the perforated surface, in particular above the suction surface having a relatively large open surface and the perforated suction surface is constricted such that a maximum air flow of, for example, 2 m/s is achieved on the outer side of the perforated suction surface.

In a further embodiment of the invention it is advantageous that the air-displacement body extends over the entire width and/or length of the suction chamber and that the air-displacement body is an approximately rectangular body, in particular a housing, which extends in the direction of the suction chamber and runs at an inclination in this direction. As a result, a uniform suction performance is ensured over the entire area of the suction apparatus.

It is also advantageous that the air-displacement body has a lower wall which encloses an angle in the longitudinal direction of the suction chamber with its lower wall, which is between 1° and 30°, in particular between 1° and 5°, wherein the gap between the air-displacement body and the perforated suction surface becomes narrower in the direction of the suction apparatus.

At the same time, it is advantageous that the air-displacement body ends with one end or its side wall adjacent a suction apparatus connected to the suction chamber.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
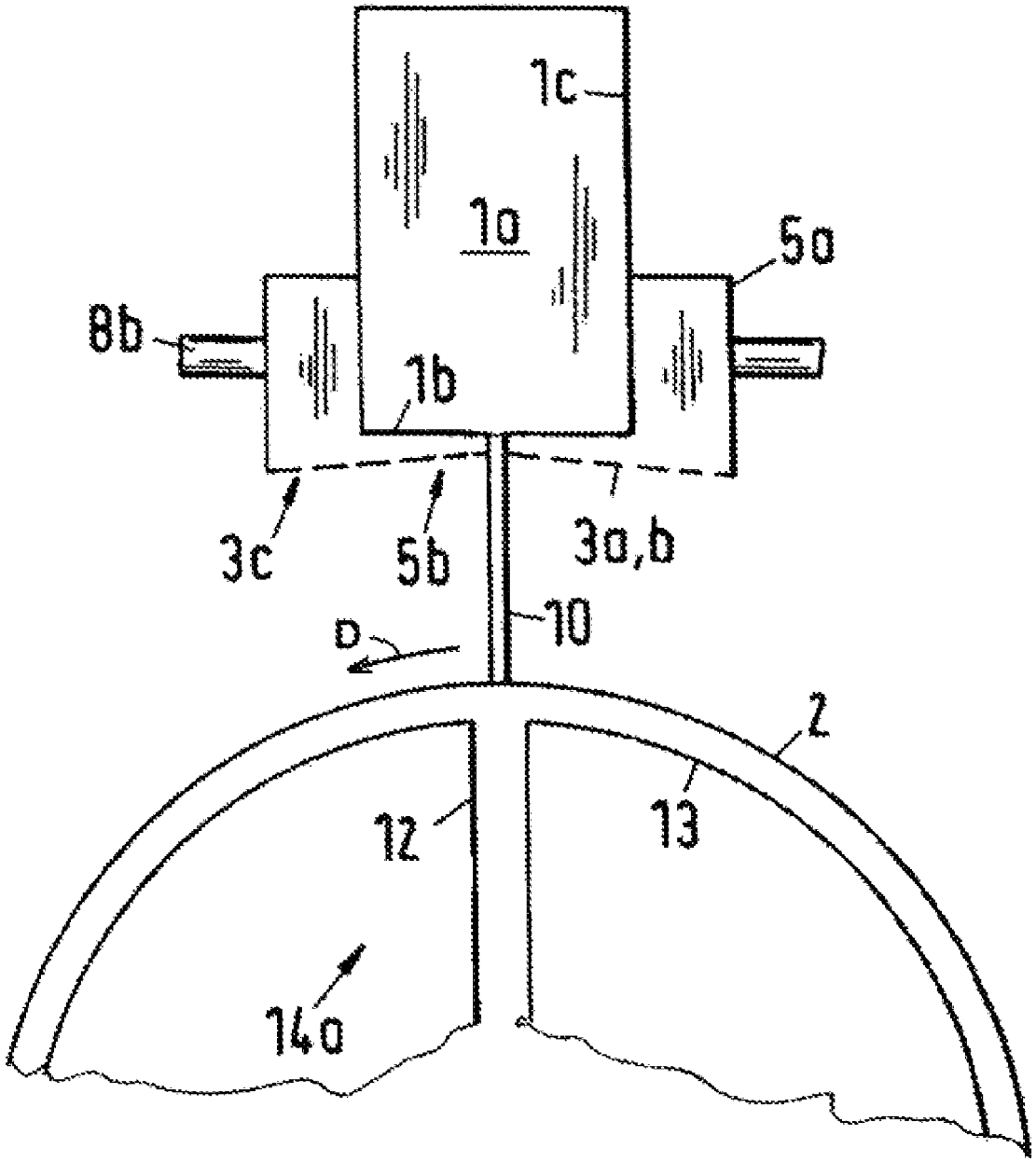
FIG. 1 is a largely diagrammatic end view of the system of this invention.

As seen in FIG. 1, water beam 1*a* emits a water jet 10 from a transversely extending row of unillustrated nozzle orifices and impinges upon a fabric workpiece 2 that can be woven, knitted, or nonwoven and that is guided over a cylindrical support drum 13 of a perforated drum or perforated roller 14*a*. Water is mostly removed by means of a water removal passage 12 of the perforated roller 14*a* that opens centrally upward in line with the jet 10.

Adjacent the water beam 1*a* is a suction apparatus or suction chamber 5*a* which has a sloping perforated suction surface 3*a*, provided with openings 3*c* on its lower wall 5*b* so that the spray formed when the water jet 10 impinges on the fabric workpiece 2 is pulled to the lower wall of the suction chamber 5*b* and is then completely sucked from the suction chamber 5*a*. Water droplets thus do not collect on the lower face of the water beam 1*a* and no longer drip onto the workpiece 2.

In this embodiment two such suction chambers 5*a* are arranged symmetrically on both sides of the water beam 1*a*, upstream and downstream relative to a workpiece travel direction D. A vacuum is created in the suction chamber 5*a* by a pump 15 (FIG. 9) connected to the suction chamber 5*a* via a suction hose 8*b*.

Figure 2:
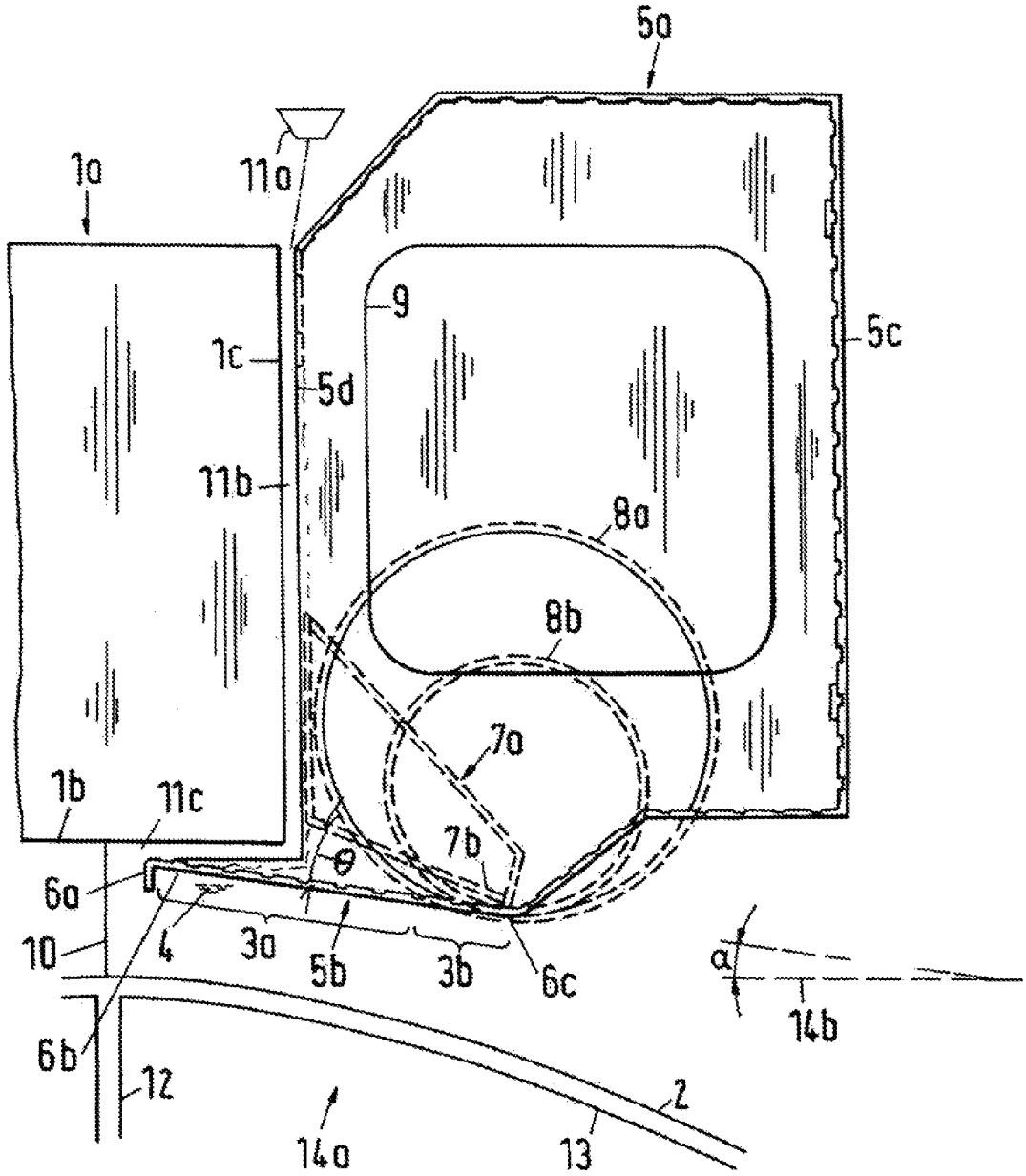
FIG. 2 is a sectional end view of the system of the present invention.

FIG. 2 shows a further embodiment of the suction chamber 5*a* for the water beam 1*a* for jet treatment of a fabric workpiece 2. It has perforated suction regions 3*a* and 3*b* on the lower wall 5*b* of the suction chamber 5*a* for the aspiration of spray. The perforated suction regions 3*a* and 3*b* are provided on an incline so that they extends from an upper edge 6*b* close to the water beam 1*a* and/or a drip edge 6*a* to a lower edge 6*c* of the suction chamber 5*a* remote from the jets 10. The first region 3*a* of the perforated suction surface has a relatively small open area, that is ratio of area of openings to area of closed portions between the openings, while the second section 3*b* of the perforated suction surface has a relatively large open/closed ratio, that is a greater portion of its overall surface area taken up by suction openings. In an embodiment not shown in the drawings the suction chamber can also be formed without the drip edge 6*a*.

The openings 3*c* in the perforated suction surface have a smaller area or flow cross-section in the region 3*a* than the openings 3*c* in the region 3*b*. In this way, an approximately uniform suction pressure is generated on the inner upper side of the suction surface 3*a* or 3*b* so that spray impinging upon the fabric workpiece 2 can easily be removed by suction. Water droplets flowing downward along the lower face of the floor 5*b* as a result of gravity can be sucked completely into the suction chamber 5*a* through the larger openings 3*c* in the lower area of the suction surface 6*c*.

The distance between the individual openings 3*c* can be the same or different. The cross-sectional areas of the openings 3*c* increase moving away from the drip edge 6*a* toward the suction chamber 5*a* or an outer wall 5*c* of the suction chamber 5*a* remote from the water beam 1*a*. To achieve this effect the cross-sectional areas of the openings 3*c* beginning from the drip edge 6*a* can become increasingly larger continuously or in uniform steps.

As can be seen from the second embodiment in FIG. 2, a horizontal tangent 14*b* to the cylindrical outer surface of the upper part of the perforated roller 14*a* forms an angle α with the lower surface of the suction surface 3*a* and 3*b*. The angle α can be between 5° and 25°, but preferably is between 6° and 15° The openings 3*c* of the inner region 3*a* closer to the water jet 10 of the water beam 1*a* account for an open area of about 3% to 8%, preferably 5% and on the outer region 3*b* then form an open area of about 10% to 25%, preferably exactly or about 20%. According to FIG. 2, the suction chamber 5*a* is located on the right-hand or upstream side of the water beam 1*a*, and can be embodied as an approximately rectangular box to receive spray 4.

According to FIG. 2, the water beam 1*a* and the suction chamber 5*a* have an associated air supply with a blower 11*a* whose output is connected to an air-supply passage 11*b* which opens horizontally near the lower wall 1*b* of the water beam 1*a* at an outlet opening 11*c* near the water jet 10. The air-supply passage 11*b* is formed by a vertical outer side wall of the water beam 1*c* and a vertical outer side wall 5*d* of the suction chamber 5*a*. For this purpose the air-supply passage 11*b* runs approximately parallel to the outer side of the water beam 1*a* and the lower wall 1*b* of the water beam 1*a*. The drip edge 6*a* of the suction chamber 5*a* is near the outlet opening 11*c* of the air-supply passage 11*b*. Only very fine water droplets can form at the drip edge 6*a*, and they cannot cause any further damage when they fall downward.

Dry air passing through the air-supply passage 11*b* of the air supply apparatus 11*a* to the water jet 10 has the advantage that it does not influence the movement of the water jet 10. The water jet 10 is thus not influenced by very fine water droplets or mist and can in particular be projected onto the fabric workpiece 2 in a focused manner. In this embodiment according to FIG. 2, dry air is pulled through the air-supply passage 11*b* by the suction effect created by the water jet 10. It is also possible for dry air to be actively supplied to the water jet 10 by means of the blower 11*a*, so that this blower is optional so long as some means is provided for moving air through the passage.

In FIG. 2 the air supply apparatus 11*a* and the suction chamber 5*a* are only located in the right-hand side of the water beam 1*a*. However, as suggested by FIG. 1, the suction chamber 5*a* can be arranged symmetrically on both sides of the water beam 1*a*. The air supply apparatus 11*a* can also be arranged symmetrically on both sides of the water beam 1*a*.

The width of the air-supply passage 11*b* is between 3 and 15 mm, preferably between 5 and 10 mm, especially between 7 and 8 mm. In this embodiment, the air-supply passage 11*b* of the air supply apparatus 11*a* is of a width of 1 to 15 mm, preferably 3 to 10 mm, and especially 3 and 6 mm between an outer face of the water beam 1*c* and the confronting outer face of the wall 5*d* of the suction chamber 5*a* facing the water beam 1*a*. In an embodiment not shown in the drawings, the air-supply passage 11*b* can also be formed by hoses or similar air supply apparatus.

The outlet opening 11*c* extends approximately over the entire length of the water beam 1*a*. The outlet opening 11*c* is further aligned so that the air jet emerging from it impinges approximately horizontally and perpendicularly on the vertical water jet 10 emerging from the water beam 1*a*.

Figure 4:
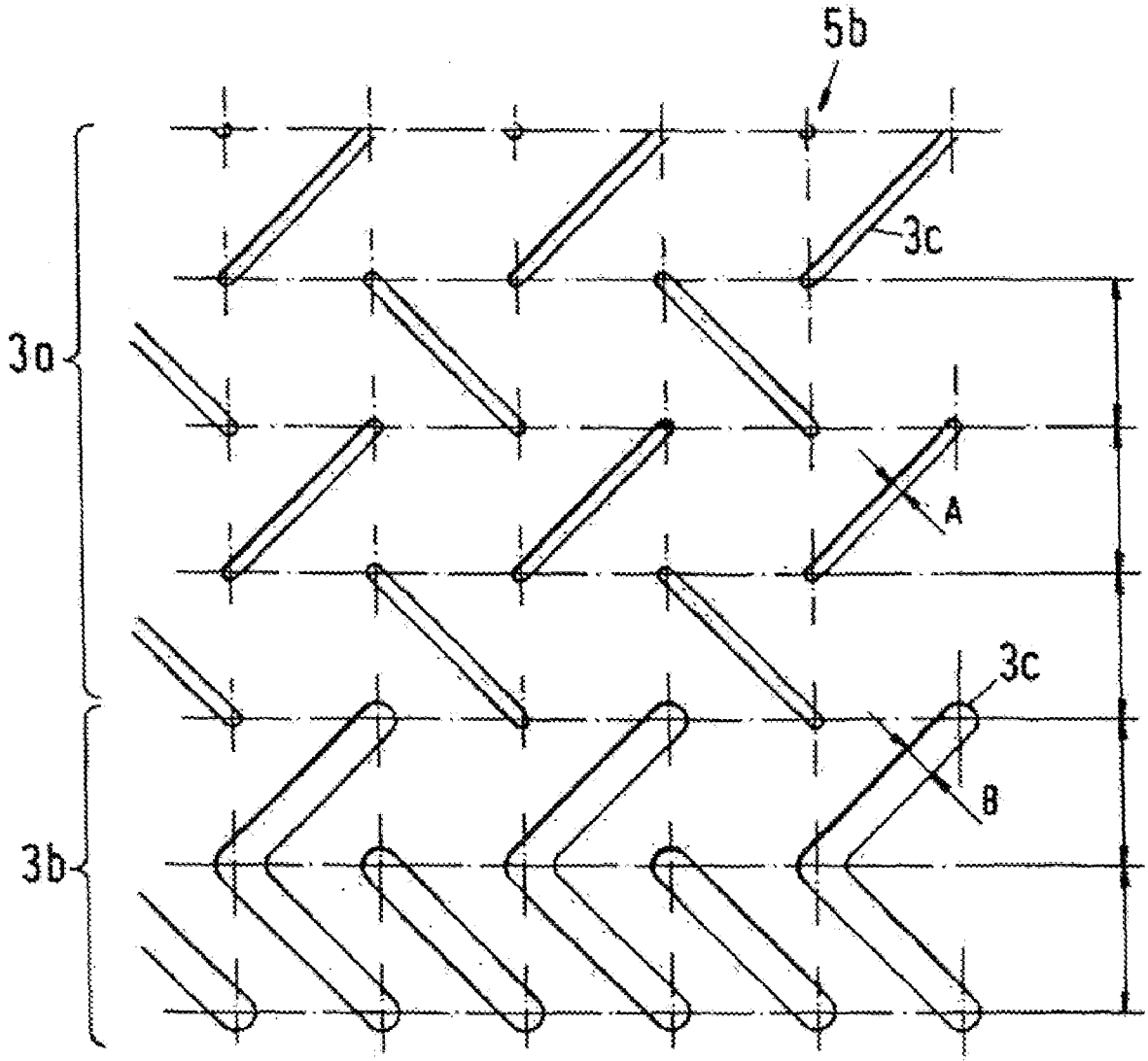
FIG. 4 is a bottom view of a the floor of the suction chamber.

According to FIG. 4, the openings 3*c* of the perforated suction surface on the side 3*a* facing the water jet 10 can be embodied as elongated approximately parallel slots having a length between 1 mm and 10 mm and a width A between 0.1 mm and 3 mm. It is furthermore possible that the slots provided on the outer side 3*b* of the perforated suction surface are preferably embodied as angular with a length between 1 mm and 10 mm and a width B between 0.1 mm and 3 mm. Depending on the embodiment, the slots can also have a linear or a corrugated profile, or even be chevron shaped. All these configurational variants of the openings 3*c* have the purpose of receiving as efficiently as possible that water droplets of the spray 4 move along the perforated suction surface. They are also oriented to prevent droplets of spray 4 from running between the openings 3*c*.

Figure 3:
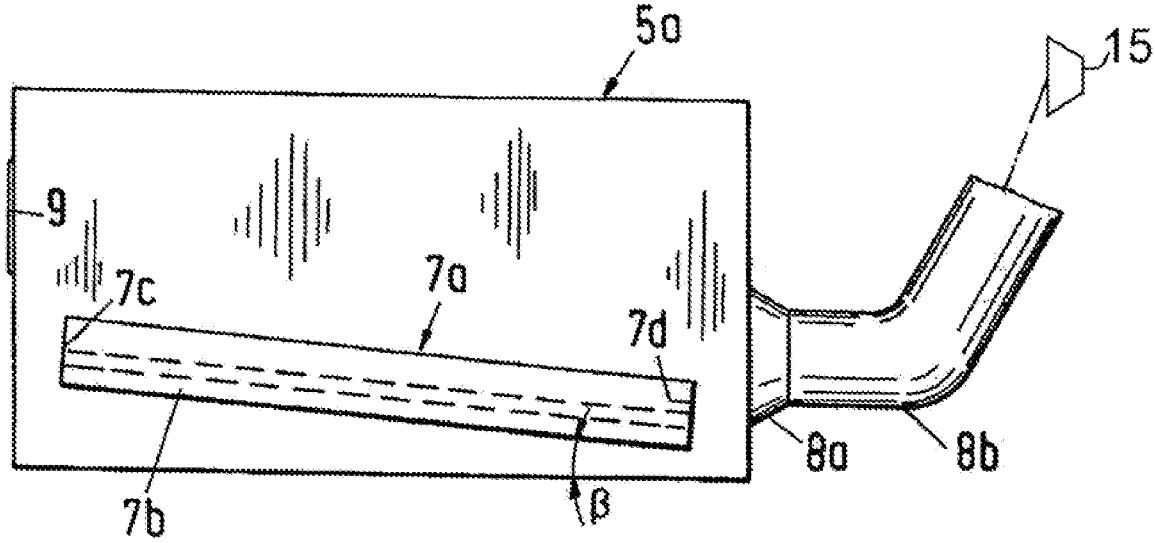
FIG. 3 is a section taken along line III-III of FIG. 2.

According to a further embodiment as shown in FIGS. 2 and 3, an air-displacement body 7*a* can be provided in the suction chamber 5*a*, which can have different shapes. According to FIGS. 2 and 3, the air-displacement body 7*a* is hollow and is defined by two parallel end walls 7*c* and 7*d*. In the area of the suction regions 3*a* and 3*b*, a lower wall 7*b* of the displacement body 7*a* runs approximately parallel to the inner surface of the perforated suction regions 3*a* and 3*b*. Between the lower wall 7*b* of the displacement body 7*a* and the inner surface of the suction surface 3*a* and 3*b* is a small gap between 2 mm and 10 mm wide that ensures that a uniform suction pressure is achieved over the entire suction surface. The air-displacement body 7*a* is located above the perforated suction regions 3*a* and 3*b*, especially above the suction surface provided with a relatively large open area 3*b* so that the perforated suction regions 3*a* and 3*b* are constricted so that a maximum air flow of 2 m/s for example is achieved at the outer side of the perforated suction surface 3*b*.

The air-displacement body 7*a* advantageously extends over the entire length of the suction chamber 5*a*. In order to achieve the greatest possible flexibility in adjusting the air flows inside the suction chamber 5*a*, in a further advantageous embodiment not shown in the drawings the air-displacement body 7*a* can be mounted so that its height and inclination can be varied.

As can be seen from FIG. 2, the lower wall 7*b* of the displacement body 7*a* extends in the same direction as the suction surface 3*a* and 3*b* and forms an angle θ between 5° and 30° therewith. As can be further seen from FIG. 3, the air-displacement body 7*a* can also enclose an angle β with its lower wall 7*b* toward the inner surface of the perforated suction regions 3*a* and 3*b*, this angle being between 1° and 30° or between 1° and 5°, the gap between the air-displacement body 7*a* and the perforated suction regions 3*a* and 3*b* becoming narrower toward a suction outlet fitting 8*a*. Located at one end of the suction chamber 5*a* is the suction apparatus consisting of the fitting or connection 8*a* and the suction hose 8*b*, via which the spray received from the suction chamber 5*a* is removed and the vacuum therein is produced by the blower 15. The interior of the suction chamber 5*a* is accessible via an access door 9.

As can be seen from FIG. 3, the air-displacement body 7*a* advantageously ends with its lower end adjacent the connection for the suction apparatus 8*a*.

I claim:

1. A suction apparatus for a water beam that directs a liquid jet at a passing a fabric web workpiece, the apparatus comprising:

a suction chamber extending transversely adjacent the jet and having a lower wall sloping downward away from an upper edge close to the water beam and a lower edge remote therefrom, the lower wall being perforated from the upper edge to the lower edge; and means for withdrawing air from inside the chamber and thereby aspirating spray from adjacent the jet through the perforated lower wall.

2. The suction apparatus defined in claim 1 wherein the perforated lower wall is formed with an array of openings of different cross-sectional area.

3. The suction apparatus defined in claim 2 wherein the perforated lower wall is formed with an array of openings having a total surface area varying between about 25% at the upper edge and 3% at the lower edge.

4. The suction apparatus defined in claim 1 wherein the lower wall forms with a horizontal plane tangent to the workpiece where it is impinged by the jet an angle between 5° and 25°.

5. The suction apparatus defined in claim 1 wherein two such suction chambers flank the liquid jet.

6. The suction apparatus defined in claim 1 wherein the perforated lower wall has openings between 0.1 mm and 3 mm wide and between 1 mm and 10 mm long.

7. The suction apparatus defined in claim 6 wherein the openings are slots.

8. A suction apparatus for a water beam that directs a liquid jet at a passing a fabric web workpiece, the apparatus comprising:

a suction chamber extending transversely adjacent the jet and having a perforated lower wall sloping downward away from an upper region close to the water beam and a lower region remote therefrom, the perforated lower wall being formed with an array of openings of different cross-sectional size; and means for withdrawing air from inside the chamber and thereby aspirating spray from adjacent the jet through the perforated lower wall, the cross-sectional areas of the openings increase away from the liquid jet.

9. The suction apparatus defined in claim 8 wherein the cross-sectional areas of the openings increase continuously away from the liquid jet.

10. The suction apparatus defined in claim 8 wherein the cross-sectional areas of the openings increase in steps from the liquid jet.

11. A suction apparatus for a water beam that directs a liquid jet at a passing a fabric web workpiece, the apparatus comprising:

a suction chamber extending transversely adjacent the jet and having a perforated lower wall sloping downward away from an upper region close to the water beam and a lower region remote therefrom, the perforated lower wall being formed with an array of openings of different cross-sectional size; and means for withdrawing air from inside the chamber and thereby aspirating spray from adjacent the jet through the perforated lower wall, a spacing between the openings varying away from the liquid jet.

12. A suction apparatus for a water beam that directs a liquid jet at a passing a fabric web workpiece, the apparatus comprising:

a suction chamber extending transversely adjacent the jet and having a perforated lower wall sloping downward away from an upper region close to the water beam and a lower region remote therefrom; and means for withdrawing air from inside the chamber and thereby aspirating spray from adjacent the jet through the perforated lower wall; and means forming a slot passage open adjacent the liquid jet for supplying air to immediately adjacent the liquid jet.

13. The suction apparatus defined in claim 12 wherein the passage is formed by a wall of the water beam and a wall of the suction chamber and has a width between 1 mm and 15 mm.

14. The suction apparatus defined in claim 12, further comprising a blower connected to the passage for forcing air thereinto.

15. The suction apparatus defined in claim 12 wherein the passage extends a full length of the water beam.

16. The suction apparatus defined in claim 12 wherein the passage has a slot outlet opening generally perpendicularly to the liquid jet.

17. The suction apparatus defined in claim 12 wherein the passage is generally L-shaped, with a vertical leg between walls of the chamber and water beam and a horizontal leg underneath the water beam.

18. A suction apparatus for a water beam that directs a liquid let at a passing a fabric web workpiece, the apparatus comprising:

a suction chamber extending transversely adjacent the jet and having a perforated lower wall sloping downward away from an upper region close to the water beam and a lower region remote therefrom;

means for withdrawing air from inside the chamber and thereby aspirating spray from adjacent the jet through the perforated lower wall; and an air-displacement body inside the suction chamber and spacedly juxtaposed with the lower wall thereof.

19. The suction apparatus defined in claim 18 wherein the air-displacement body extends over an entire length of the suction chamber.

20. The suction apparatus defined in claim 18 wherein air is drawn from a longitudinal vent end of the suction chamber and the air-displacement body has a lower wall forming an angle extending longitudinally parallel to the water jet of between 10° and 30° such that a gap between the lower wall of the body and the lower wall of the chamber decreases toward the vent end.

* * * * *